US007104935B2

(12) United States Patent
Matsuoka

(10) Patent No.: US 7,104,935 B2
(45) Date of Patent: Sep. 12, 2006

(54) EXPANDER FOR THE LOWER PART OF THE BODY

(76) Inventor: Makoto Matsuoka, 3-17-11, Hyogotsuka, Utsunomiya, Tochigi (JP), 321-0138

( * ) Notice: Subject to any disclaimer, the term of this patent is extended or adjusted under 35 U.S.C. 154(b) by 601 days.

(21) Appl. No.: 10/160,635

(22) Filed: May 31, 2002

(65) Prior Publication Data

US 2003/0027698 A1 Feb. 6, 2003

(30) Foreign Application Priority Data

Jun. 2, 2001 (JP) ..... 2001-205422
Oct. 22, 2001 (JP) ..... 2001-360108

(51) Int. Cl.
*A63B 21/00* (2006.01)

(52) U.S. Cl. ..... 482/124; 482/121; 482/129
(58) Field of Classification Search ..... 482/121–130, 482/907, 140, 141
See application file for complete search history.

(56) References Cited

U.S. PATENT DOCUMENTS 1,734,238 A * 11/1929 Sweeney ..... 482/123
1,952,750 A * 3/1934 Gailey ..... 482/125
3,442,513 A * 5/1969 Fisher et al. ..... 473/208
5,096,199 A * 3/1992 Wyatt et al. ..... 473/212
5,916,070 A * 6/1999 Donohue ..... 482/74
6,093,137 A * 7/2000 Summers ..... 482/125
6,544,152 B1 * 4/2003 Rosati ..... 482/126

* cited by examiner

*Primary Examiner*—Jerome W. Donnelly
(74) *Attorney, Agent, or Firm*—Gerald E. Hespos; Anthony J. Casella

(57) ABSTRACT

An expander for the lower part of the body is provided with a lumbar band (1) having corresponding catching members (2), an elastic strip (7) insertably fitted into and woven with the lumbar band (1), and a sole contact plate (6) having inserting portions (3) for both feet mounted thereon. The elastic strip (7) is woven around a substantially back half of the lumbar band (1), and coupling rings (7*b*) mounted at the opposite outer ends of the elastic strip (7) pulled out from the opposite sides of a front part of the lumbar band (1) are coupled to corresponding upper-end hooks (20*a*) of length-adjustable straps (20) connected with side portions (6*a*) of the sole contact plate (6) in a looped state.

5 Claims, 6 Drawing Sheets

EXPANDER FOR THE LOWER PART OF THE BODY

BACKGROUND OF THE INVENTION

1. Field of the Invention

The present invention relates to an expander for the lower part of the body which expander can be easily used at home and other places by anybody for straightening the lumbar to prevent lower back pains and strengthening the leg and abdomen muscles.

2. Description of the Related Art

Exercise assisting equipments and health equipments for home use such as a hanging health equipment, a walker, a rowing machine and a cyclista are on the market. Since an installation space needs to be secured for any of these equipments, they stand in the way when being not used due to the recent housing situation apart from cases where a specified gym can be provided and they are, of course, not suited to being carried out. Further, after being continuously used for a certain period of time, they are sometimes bored and left unused.

The same applies to health equipments for preventing lower back pains such as lumbago.

No health equipment has not been available yet which can simultaneously accomplish the sure traction stretch of the lumbar, particularly the sacra which are fourth and fifth vertebrae regarded to be difficult to pull by conventional health equipments and the strengthening of the leg and abdomen muscles.

On the other hand, equipments for training the lower back and the legs by fastening a belt around the lower back are proposed in Registered Japanese Utility Model No. 20818, Unexamined Utility Model Publication No. 55-72971 and Unexamined Utility Model Publication No. 57-123167. The waist belt is merely used to fix the lower back and has a little effect on the traction of the lumbar because these equipments are designed for the leg exercise.

A lumbar band of an expander for the lower part of the body according to the present invention has a double structure by being woven with an elastic strip, and a horizontal force (see A in FIG. 6(A)) necessary to hold the lumbar and a vertical force (see B in FIG. 6(B)) necessary for the traction and straightening, i.e. a composite traction force, can be created by the elastic strip. As far as the inventor knows, there has been no expander which can simultaneously perform the traction of the lower back necessary for the prevention of lower back pains and the strengthening of the leg and abdomen muscles combined with the movements of the legs by one exercise.

In view of the above problems existing in the prior art, an object of the present invention is to mainly simultaneously perform the traction and straightening of the lumbar and the strengthening of the abdomen and leg muscles and to provide an expander for the lower part of the body which can be easily stored and carried around, can be simply used at home by anybody, and can prevent lower back pains.

SUMMARY OF THE INVENTION

In order to accomplish the above object, as shown in FIGS. 1 and 2, the invention is directed to an expander for the lower part of the body, comprising a lumbar band (1) having corresponding catching members (2), an elastic strip (7) insertably fitted into and woven with the lumbar band (1), a sole contact plate (6) having inserting portions (3) for both feet mounted thereon, wherein the elastic strip (7) is woven around a substantially back half of the lumbar band (1), and coupling rings (7*b*) mounted at the opposite outer ends (7*a*) of the elastic strip (7) pulled out from the opposite sides of a front part of the lumbar band (1) are coupled to corresponding upper-end hooks (20*a*) of length-adjustable straps (20) connected with side portions (6*a*) of the sole contact plate (6) in a looped state.

Further, as shown in FIG. 3, the invention is also directed to an expander for the lower part of the body, comprising a lumbar band (1) having corresponding catching members (2), elastic tubes (8) insertably fitted into and woven with the lumbar band (1), a sole contact plate (6) having inserting portions (3) for both feet mounted thereon, wherein a plurality of elastic tubes (8) are insertably fitted around a substantially back half of the lumbar band (1), and coupling rings (9) mounted at the opposite outer ends of the elastic tubes (8) pulled out from the opposite sides of a front part of the lumbar band (1) are coupled to corresponding upper-end hooks (20*a*) of length-adjustable straps (20) connected with side portions (6*a*) of the sole contact plate (6) in a looped state.

Furthermore, as shown in FIG. 4, the invention is also directed to an expander for the lower part of the body, comprising a lumbar band (1) having corresponding catching members (2), an elastic strip (7) insertably fitted into and woven with the lumbar band (1), a sole contact plate (6) having inserting portions (3) for both feet mounted thereon, wherein coated wires (10) connected with the opposite outer ends of the elastic strip (7) are inserted through the lumbar band (1) and pulled out from the opposite sides of a front part of the lumbar band (1), coupling hooks (11) mounted at the outer ends of the coated wires (10) are coupled to an upper-end coupling ring (13) of one looped elastic strip (12) of a specified length, and a bottom-end coupling ring (14) of the elastic strip (12) is coupled to an upper-end hook (20*a*) of one length-adjustable strap (20) connected with a coupling ring (7*c*) provided at a center portion (6*b*) of the sole contact plate (6).

In terms of construction, a double structure of the band for fixing the lumbar and the elastic strip located around the lumbar is integrated into one belt, enabling a stable operation. More specifically, at the time of traction, a horizontal force (see A in FIG. 6(A)) necessary to hold the lumbar and a vertical force (see B in FIG. 6(B)) necessary for the traction are created in a composite manner in the elastic strip located around the lumbar, whereby the traction of the lumbar is performed while squeezing and twisting the lumbar to straighten it.

These and other objects, features and advantages of the present invention will become more apparent upon a reading of the following detailed description and accompanying drawings.

DETAILED DESCRIPTION OF THE PREFERRED EMBODIMENT

The inventive device is used as shown in FIGS. 5 and 6.

Figure 1:
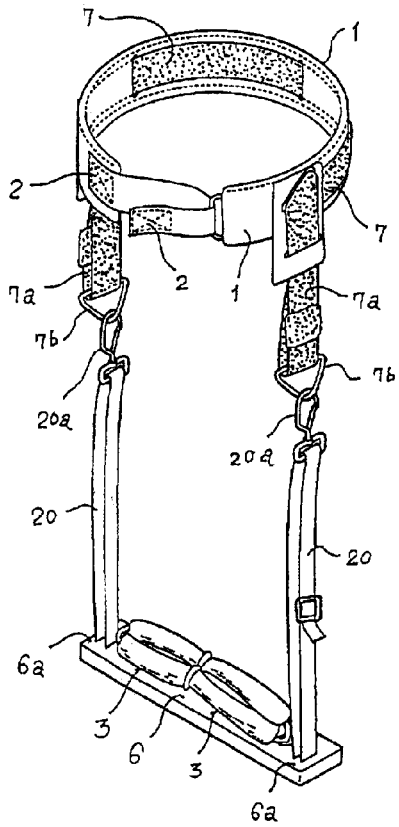
FIG. 1 is a perspective view of one embodiment of the invention.
Figure 2:
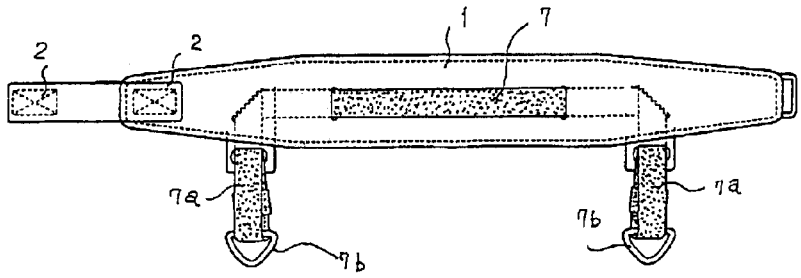
FIG. 2 is a development of the inner side of a lumbar band.
Figure 3:
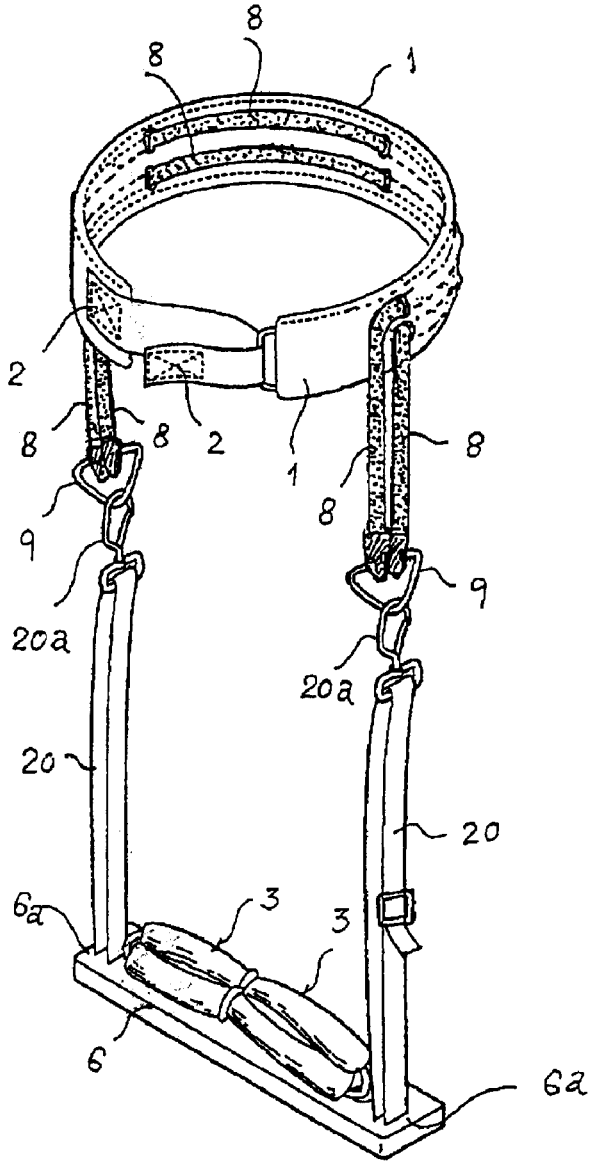
FIG. 3 is a perspective view of another embodiment of the invention.
Figure 4:
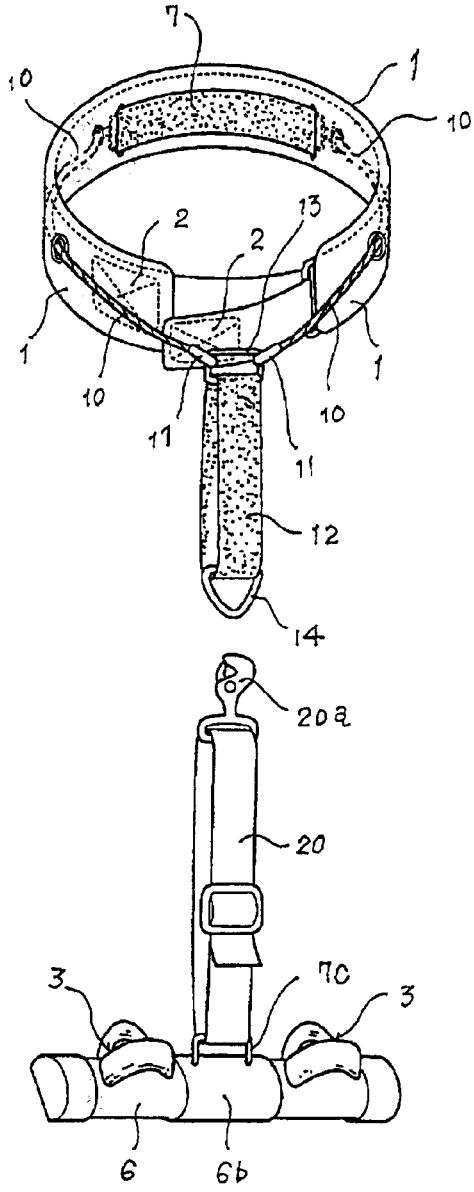
FIG. 4 is a perspective view of still another embodiment of the invention.
Figure 5A:
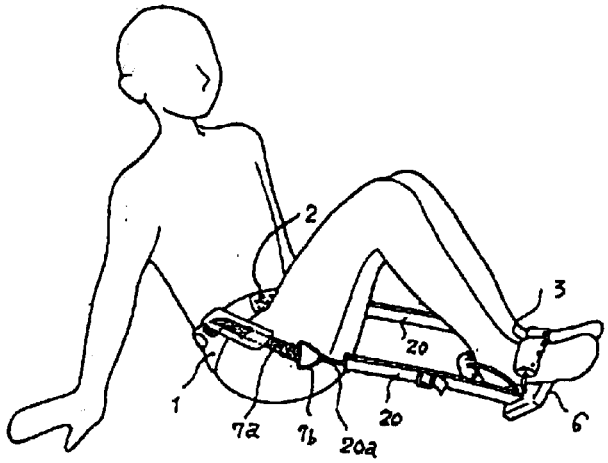
FIGS. 5(A) and 5(B) are perspective views showing used states.

(a) The lumbar band 1 is fitted around the upper part of the hipbone and fastened by the corresponding catching members 2 (see FIG. 5(A)).

(b) Both feet are inserted into the inserting portions 3 and placed on the sole contact plate 6 (see FIG. 5(A)).

Figure 5B:
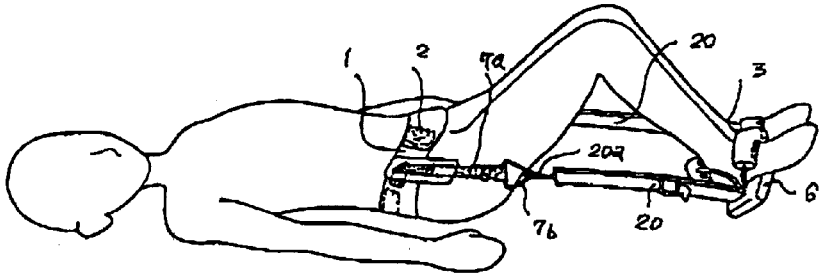

(c) Lie on the back (see FIG. 5(B)).

Figure 6A:
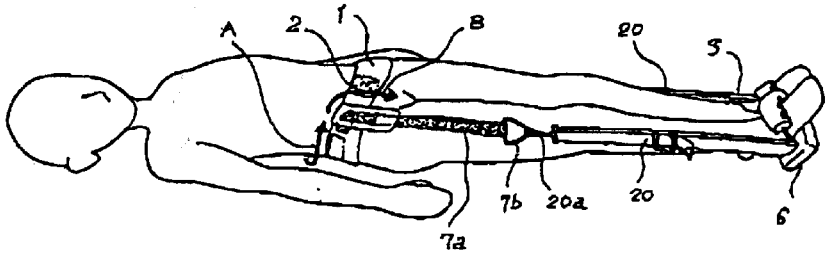
FIGS. 6(A) and 6(B) are perspective view showing used states.
Figure 6B:
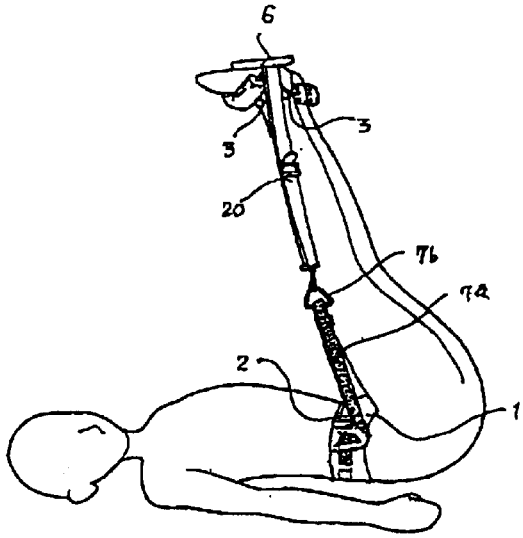

(d) The legs are stretched by being moved between a horizontal position and a vertical position using the elastic action (a combination of pulling and contracting movements) of the elastic strip 7, thereby creating a traction force in the lower back and, at the same time, strengthening the leg and abdomen muscles (see FIGS. 6(A), 6(B)).

By horizontally stretching the legs out during the above movement (d), the horizontal force (see A in FIG. 6(A)) necessary to hold the lower back and the vertical force (see B in FIG. 6(B)) necessary for the traction are created in a composite manner at the lumbar via the lumbar band 1 woven with the elastic strip 7 fitted around the upper part of the hipbone, whereby the lower back is pulled and straightened while being squeezed and twisted to give a comfortable feeling to the entire lumbar. In this way, an immediate effect can be displayed on the prevention of lower back pains such as lumbago.

Further, the leg and abdomen muscles can be strengthened by expanding and contracting the elastic strip by the legs, whereby a reduction in the muscular strength of the legs and the abdomen as one cause of lower back pains can be complemented. An important characteristic of the present invention is to simultaneously accomplish the respective effects of the traction of the lower back and the strengthening of the legs and abdomen by one exercise.

Figure 7A:
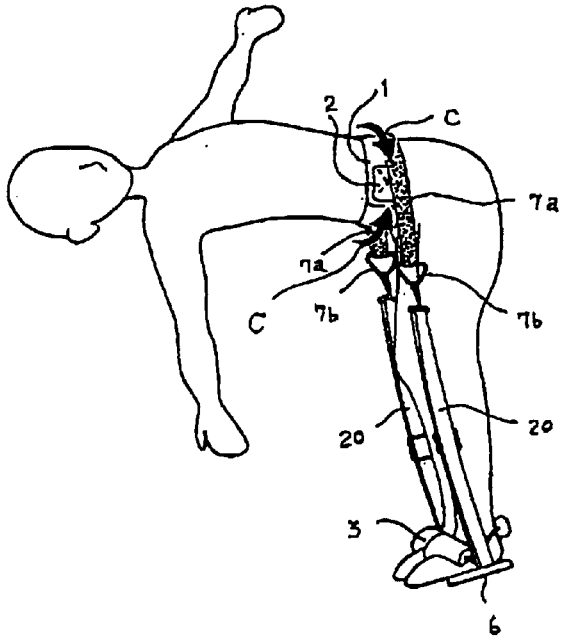
FIGS. 7(A) and 7(B) are perspective views showing used states.
Figure 7B:
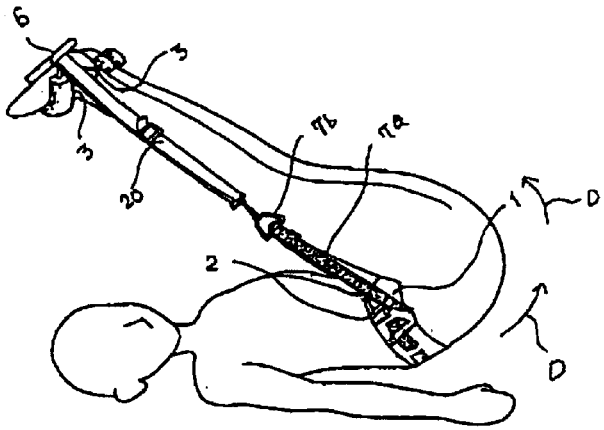

Further, the pressing of the soles by the sole contact plate, and the twisting of the lower back and the stretching of the muscles of the buttocks and thighs which are required to prevent the lower back pains can be effectively and easily performed as incidental movements with the lower back as a center by the sufficient holding of the lower back given by the double structure of the elastic strip of the lumbar band (see C in FIG. 7(A) and D in FIG. 7(B)).

By repeatedly moving the legs between the horizontal and vertical positions, the leg and abdomen muscles can be strengthened. Further, the arches of the feet inserted into the inserting portions 3 are pressed by the sole contact plate 6 to improve the blood circulation and activate many internal organs. Since an exercise is stably made while both feet are put together, the forces are transversely equally distributed and the well-balanced traction in accordance with the basic Oriental medicine can be performed.

The inventive expander constructed as above can be folded in a compact manner when being not used, does not take up a large space to be stored and carried around, and can be relatively inexpensive because having a simple construction.

This expander can be easily used at home by anybody and can simultaneously perform the traction and straightening of the lumbar, the active strengthening of the leg and abdomen muscles, and the pressing of the soles by one exercise.

Particularly, the lumbar band 1 woven with the elastic strip 7 is used at the lumbar instead of a mere waist band for fixing the lower back. By fitting this lumbar band 1 at the lumbar and stretching the legs between the horizontal position and the vertical position, the horizontal force necessary to hold the lower back and the vertical force necessary for the traction are created in a composite manner at the lumbar, whereby the lower back is pulled and straightened while being squeezed and twisted and, at the same time, the leg and abdomen muscles can be strengthened. Thus, a reduction in the muscular strength as one cause of lower back pains can be complemented. In this way, an immediate effect can be displayed on the prevention and rehabilitation of lower back pains such as lumbago. Since the user makes an exercise while lying on his back, he does not get excessively tired during the use and can get a comfortable exercise effect after the use.

Since the elastic load of the expander can be freely changed by the length-adjustable straps, this expander can be widely used among athletes and players, people in general and elderly people.

What is claimed is:

1. An expander for the lower part of the body, comprising:

a lumbar band (1) having corresponding catching members (2), an elastic strip (7) insertably fitted into and woven with the lumbar band (1), and a sole contact plate (6) having inserting portions (3) for both feet mounted thereon, wherein the elastic strip (7) is woven around a substantially back half of the lumbar band (1), and coupling rings (7*b*) mounted at the opposite outer ends of the elastic strip (7) pulled out from the opposite sides of a front part of the lumbar band (1) are coupled to corresponding upper-end hooks (20*a*) of length-adjustable straps (20) connected with side portions (6*a*) of the sole contact plate (6) in a looped state.

2. An expander for the lower part of the body, comprising:

a lumbar band (1) having corresponding catching members (2), elastic tubes (8) insertably fitted into and woven with the lumbar band (1), and a sole contact plate (6) having inserting portions (3) for both feet mounted thereon, wherein a plurality of elastic tubes (8) are insertably fitted around a substantially back half of the lumbar band (1), and coupling rings (9) mounted at the opposite outer ends of the elastic tubes (8) pulled out from the opposite sides of a front part of the lumbar band (1) are coupled to corresponding upper-end hooks (20*a*) of length-adjustable straps (20) connected with side portions (6*a*) of the sole contact plate (6) in a looped state.

3. An expander for the lower part of the body, comprising:

a lumbar band (1) having corresponding catching members (2), an elastic strip (7) insertably fitted into and woven with the lumbar band (1), and a sole contact plate (6) having inserting portions (3) for both feet mounted thereon, wherein coated wires (10) connected with the opposite outer ends of the elastic strip (7) are inserted through the lumbar band (1) and pulled out from the opposite sides of a front part of the lumbar band (1), coupling hooks (11) mounted at the outer ends of the coated wires (10) are coupled to an upper-end coupling ring (13) of one looped elastic strip (12) of a specified length, and a bottom-end coupling ring (14) of the elastic strip (12) is coupled to an upper-end hook (20*a*) of one length-adjustable strap (20) connected with a coupling ring (7*c*) provided at a center portion (6*b*) of the sole contact plate (6).

4. The expander of claim 1, wherein the inserting portions (3) are mounted on portions of the sole contact plate (6) between the respective length-adjustable straps (20).

5. The expander of claim 3, wherein the inserting portions (3) are disposed at positions on the sole contact plate (6) on opposite respective sides of the coupling ring (7*c*).

* * * * *